US007412925B2

(12) United States Patent
Helmstädter et al.

(10) Patent No.: US 7,412,925 B2
(45) Date of Patent: Aug. 19, 2008

(54) DEVICE FOR CHANGING OVER GRIPPER CONTROL IN A TURNING CONFIGURATION OF A SHEET-PROCESSING MACHINE

(75) Inventors: Karl-Heinz Helmstädter, Heidelberg (DE); Ernst-Christian Maschler, Heidelberg (DE); Thomas Schmidt, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 405 days.

(21) Appl. No.: 11/242,764

(22) Filed: Oct. 4, 2005

(65) Prior Publication Data

US 2006/0070541 A1 Apr. 6, 2006

(30) Foreign Application Priority Data

Oct. 4, 2004 (DE) ..... 10 2004 048 111

(51) Int. Cl.
*B41F 21/10* (2006.01)

(52) U.S. Cl. ..... 101/230; 101/246; 101/410

(58) Field of Classification Search ..... 101/246, 101/230, 410
See application file for complete search history.

(56) References Cited

U.S. PATENT DOCUMENTS

| | | | | |
|---|---|---|---|---|
| 4,120,244 A | | 10/1978 | Wirz | 101/230 |
| 5,031,531 A | * | 7/1991 | Becker | 101/230 |
| 5,136,946 A | | 8/1992 | Becker | 101/410 |

FOREIGN PATENT DOCUMENTS

| | | |
|---|---|---|
| DE | 26 04 895 | 8/1977 |
| DE | 40 04 352 C1 | 6/1991 |

* cited by examiner

*Primary Examiner*—Leslie J Evanisko
(74) *Attorney, Agent, or Firm*—Laurence A. Greenberg; Werner H. Stemer; Ralph E. Locher

(57) ABSTRACT

In a device for changing over a gripper control in a turning configuration of a sheet-processing machine, there is provided a slide to be guided axially displaceably by radial stops. The device changes over a gripper control from recto printing to verso printing on a transfer device such as a drum or a cylinder of a turning configuration in a sheet-processing machine.

11 Claims, 5 Drawing Sheets

DEVICE FOR CHANGING OVER GRIPPER CONTROL IN A TURNING CONFIGURATION OF A SHEET-PROCESSING MACHINE

BACKGROUND OF INVENTION

Field of Invention

In turning configurations of sheet-processing machines, in particular printing machines, there is the problem that the grippers of the turning and storage drums follow different closing and opening times during turning from those during recto printing. As is known, these closing and opening times are generated by different control cams for verso and recto printing.

It is known from German patent DE 40 04 352 C1, corresponding to U.S. Pat. No. 5,136,946, for example, in order to initiate an opening and closing movement of the grippers, to dispose a carrier for the control rollers axially displaceably in such a way that, depending on the operating mode, the grippers can be brought into operative contact with two control cams disposed in parallel. For this purpose, the carrier is released, displaced into the desired position and detained there.

In the prior art according to German patent DE 40 04 352 C1, corresponding to U.S. Pat. No. 5,136,946, there is provision for a slide-shaped carrier to be drawn into the channel bottom by armatures and detained by friction. In this case, the holding forces act counter to the reaction forces of the cam rollers. For this reason, when the cam roller force is increased, for example when the turning configuration is configured for higher processing speeds, the holding forces also have to be increased.

In the known systems, an increase in the roller forces leads to deformations of the slide and therefore also to deformations and angular errors of the elements, such as, for example, toothing, fastened to the slide, in relation to the gripper bridge pinion. Such deformations and angular errors are detrimental to service lives and in the worst case may even lead to sheet transport problems.

SUMMARY OF THE INVENTION

It is accordingly an object of the invention to provide a device for changing over gripper control in a turning configuration of a sheet-processing machine which overcomes the above-mentioned disadvantages of the prior art devices of this general type.

With the foregoing and other objects in view there is provided, in accordance with the invention, a device for changing over a gripper control from recto printing to verso printing on a transfer device such as a drum or a cylinder of a turning configuration in a sheet-processing machine. The transfer device has a channel formed therein. The device contains a control unit for actuating grippers, radial stops radially disposed in the channel of the transport device, spring-loaded force accumulators disposed in the channel, and an axially adjustably disposed slide carrying the control unit. The slide is guided axially displaceably in the channel of the transport device by the radial stops. In each operating state, the slide is pressed, free of play, against the radial stops by the spring-loaded force accumulators.

The object on which the invention is based is, therefore, to provide a device for fastening the gripper roller carrier, the device allowing a fault free detention of the slide even in the case of high cam roller forces.

It is a particular advantage of the invention that handling is also simplified at the same time. Whereas, in the prior art, it was necessary to set the tooth play between the toothed quadrant fastened to the slide and the gripper pinion disposed on the cylinder laboriously by washers which were introduced between the cylinder channel and slide, this measure may now advantageously be dispensed with, since easily accessibly, eccentrically adjustable stops are provided for mounting, thus appreciably simplifying handling during the mounting operation.

In an advantageous refinement, the slide has a two-part configuration, the two parts being coupled to one another only by one joint. This measure ensures a compensation of angular errors between the pinions and toothed quadrants.

A further advantageous measure is the configuration of a frictional coating between slide and cylinder, the frictional coating counteracting an axial displacement of the slide. The frictional coating is advantageously produced from, for example, EKA GRIP. Alternatively, positive fixing by a spring/ball system is provided.

Other features which are considered as characteristic for the invention are set forth in the appended claims.

Although the invention is illustrated and described herein as embodied in a device for changing over gripper control in a turning configuration of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
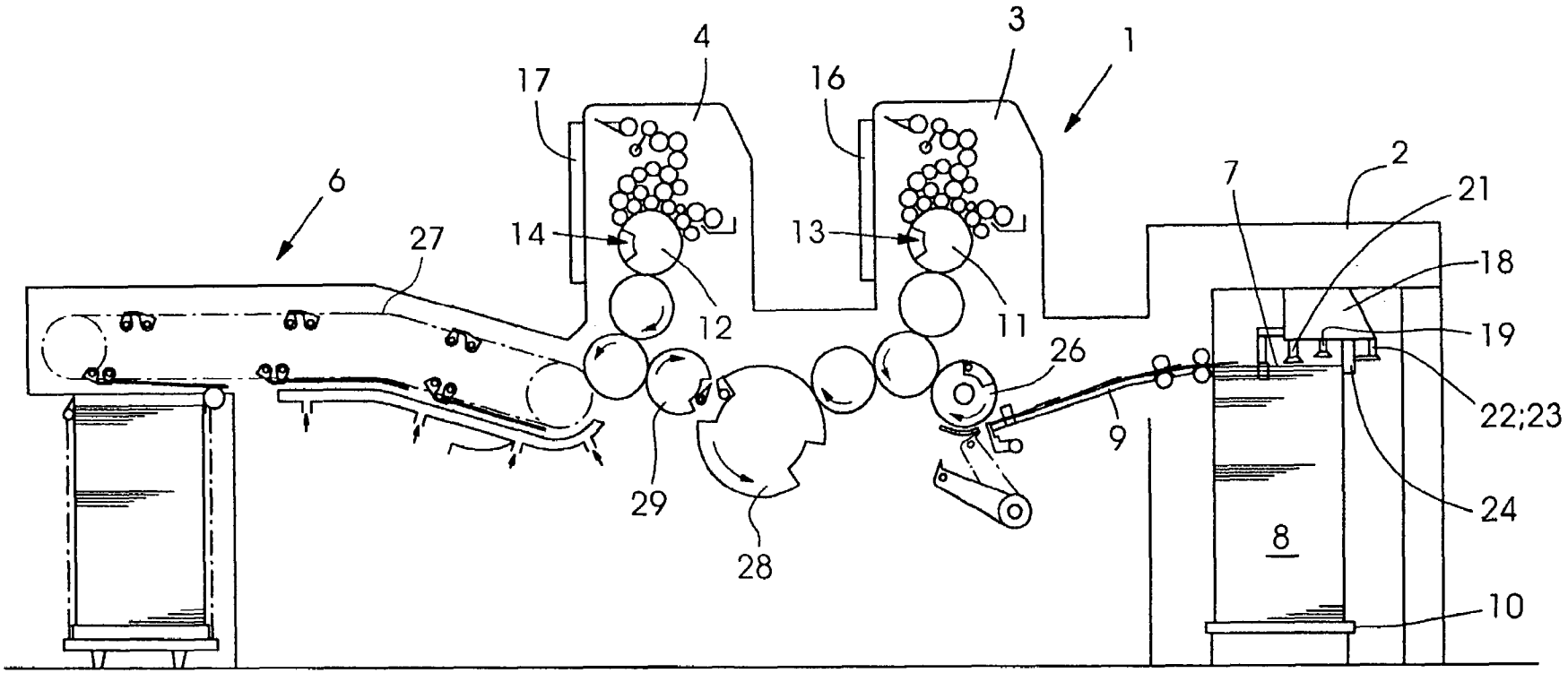
FIG. 1 is a diagrammatic, sectional view of a sheet-fed rotary printing machine according to the invention.

Referring now to the figures of the drawing in detail and first, particularly, to FIG. 1 thereof, there is shown a machine which processes sheets 7, for example a printing machine 1, that has a feeder 2, at least one printing unit 3 and 4 and a delivery 6. The sheets 7 are extracted from a sheet stack 8 and supplied, separated singly or in imbricated form, via a supply table 9 to the printing units 3 and 4. These each contain in a known way a plate cylinder 11, 12. The plate cylinders 11 and 12 each have a device 13, 14 for the fastening of flexible printing plates. Furthermore, each plate cylinder 11, 12 is assigned a device 16, 17 for semiautomatic or fully automatic printing plate change.

The sheet stack 8 lies on a stack plate 10 capable of being raised in a controlled manner. The extraction of the sheet 7 takes place from the top side of the sheet stack 8 by what is known as a suction head 18 which has inter alia a number of lifting and dragging suckers 19, 21 for separating the sheets 7 singly. Furthermore, a blowing unit 22 for loosening the upper sheet layers and tracer elements 23 for the stack follow-up are provided. For the alignment of the sheet stack 8, in particular of the upper sheets 7 of the sheet stack 8, a number of lateral and rear stops 24 are provided.

The sheet 7 conveyed through the printing machine 1 is conveyed from a supply cylinder 26 as far as the chain systems 27 of the delivery 6 by gripper-carrying cylinders and drums, a turning configuration for recto and verso printing being provided between the printing units 3 and 4. This includes a storage drum 28 and a turning drum 29. The turning drum 29 is adjustable in such a way that, during turning, grippers 31 take over the sheet 7 at its trailing edge from the storage drum 28, in contrast to recto printing. For this purpose, inter alia, the gripper opening and closing movement must take place differently from recto printing.

During recto printing, the gripper opening and closing movement is controlled by two control cams 32, 33 (FIG. 2) disposed in each case in a stationary manner on the machine stand laterally with respect to the turning drum 29. During turning, the control of the gripper opening and closing movement takes place by control cams 34, 36 disposed directly next to them in each case. The control cams 32 to 36 are in working contact with two control rollers 41, 42 disposed in each case laterally on an axially displaceable slide 37 in a channel 38 of the turning drum 29 (FIG. 3). The control cams give rise, in each case via a control lever 43, 44, to a pivoting movement of a toothed quadrant 46, 47 which is in toothed engagement with a pinion 48, 49. The pinions 48, 49 generate a pivoting movement of a gripper shaft 51 on which the tongue grippers 31 provided for turning the sheet are seated.

Figure 4:
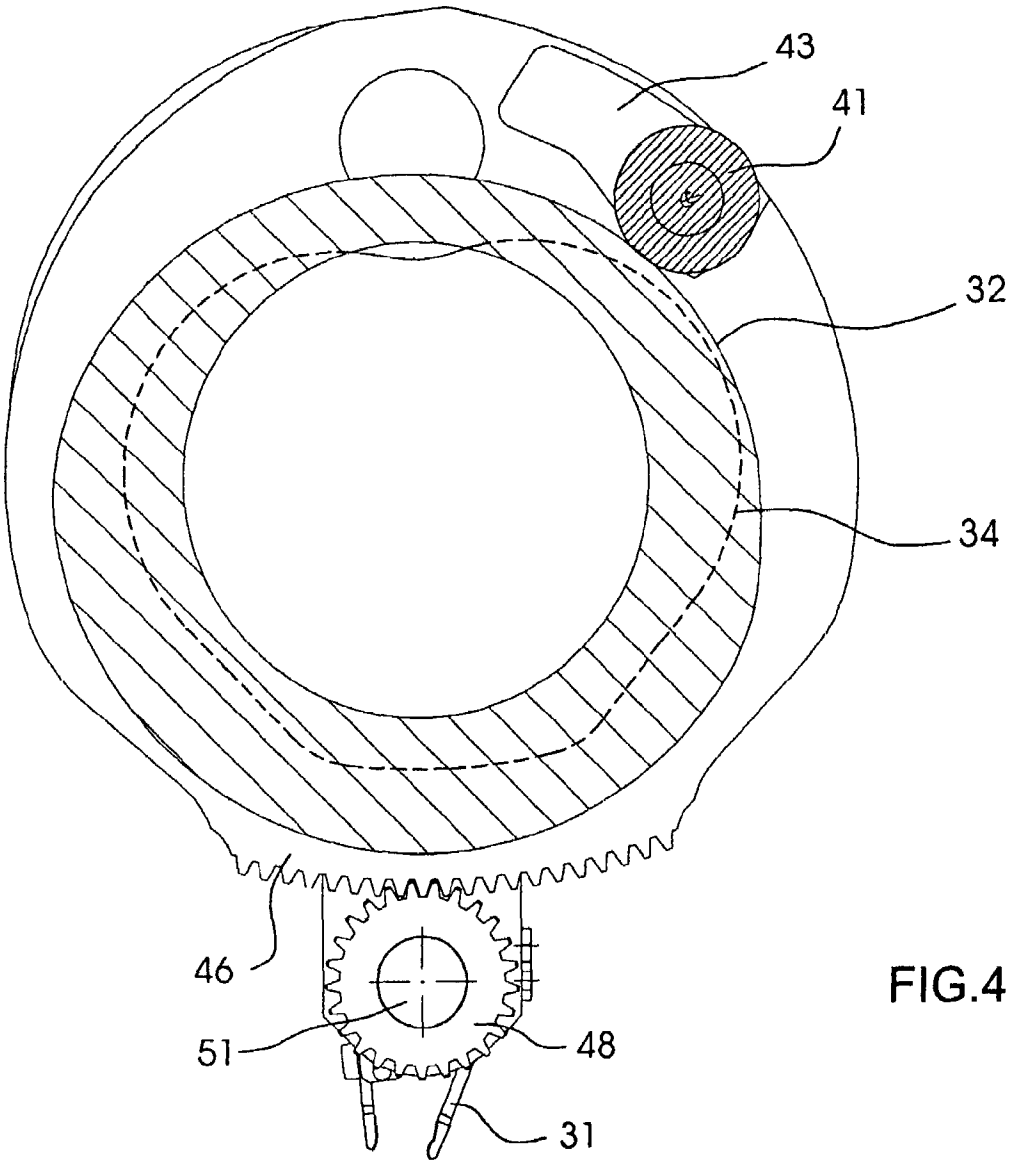
FIG. 4 is a diagrammatic, sectional view taken along the line III-III shown in FIG. 2.

To change over the gripper opening and closing times, the control rollers 41, 42, which co-operate with the control cams 32, 33 during recto printing, must be brought into operative contact with the control cams 34, 36. For this purpose, the slide 37 is displaced axially until the control rollers 41, 42 come into operative contact with the control cams 34, 36. The end positions of an eccentric 76 limit the two end positions of the slide 37 and thus simplify the changeover. The pinions 48, 49 are configured with a width such that the toothed quadrants 46, 47 remain constantly in toothed engagement with the pinions 48, 49 (FIG. 4).

The slide 37 is guided in the cylinder channel 38. The guide is formed by lateral stops 52, 53 which are screwed to the cylinder body 29. The stops 52, 53 each have a guide groove 54, 56 serving as a radial stop for guide elements 57, 58 which are disposed laterally on the slide 37. The stops 52, 53 are disposed in such a way that they absorb the operationally acting radial forces, for example centrifugal forces or roller forces, of the slide 37. The guide elements 57, 58 each have an eccentric adjustment 50, 55 for adapting the height or the radial position of the slide 37 with respect to the cylinder 29 or for setting the tooth play between the toothed quadrant 46, 47 and the pinion 48, 49. So as always to press the guide elements 57, 58 against the stops 52, 53 with a defined minimum force, a spring-supported plate 65 is used, on which the slide 37 can be moved axially with low friction by a roller 60. One or more helical springs 79 generating the spring force are supported in the cylinder channel 38 on the cylinder body 29.

To secure the slide 37 against undesirable axial displacement in the cylinder channel 38, it is sufficient to have a frictional layer (for example, EKA GRIP) which is applied to the underside of the slide 37 and/or to the bottom of a supporting device 74.

Figure 2:
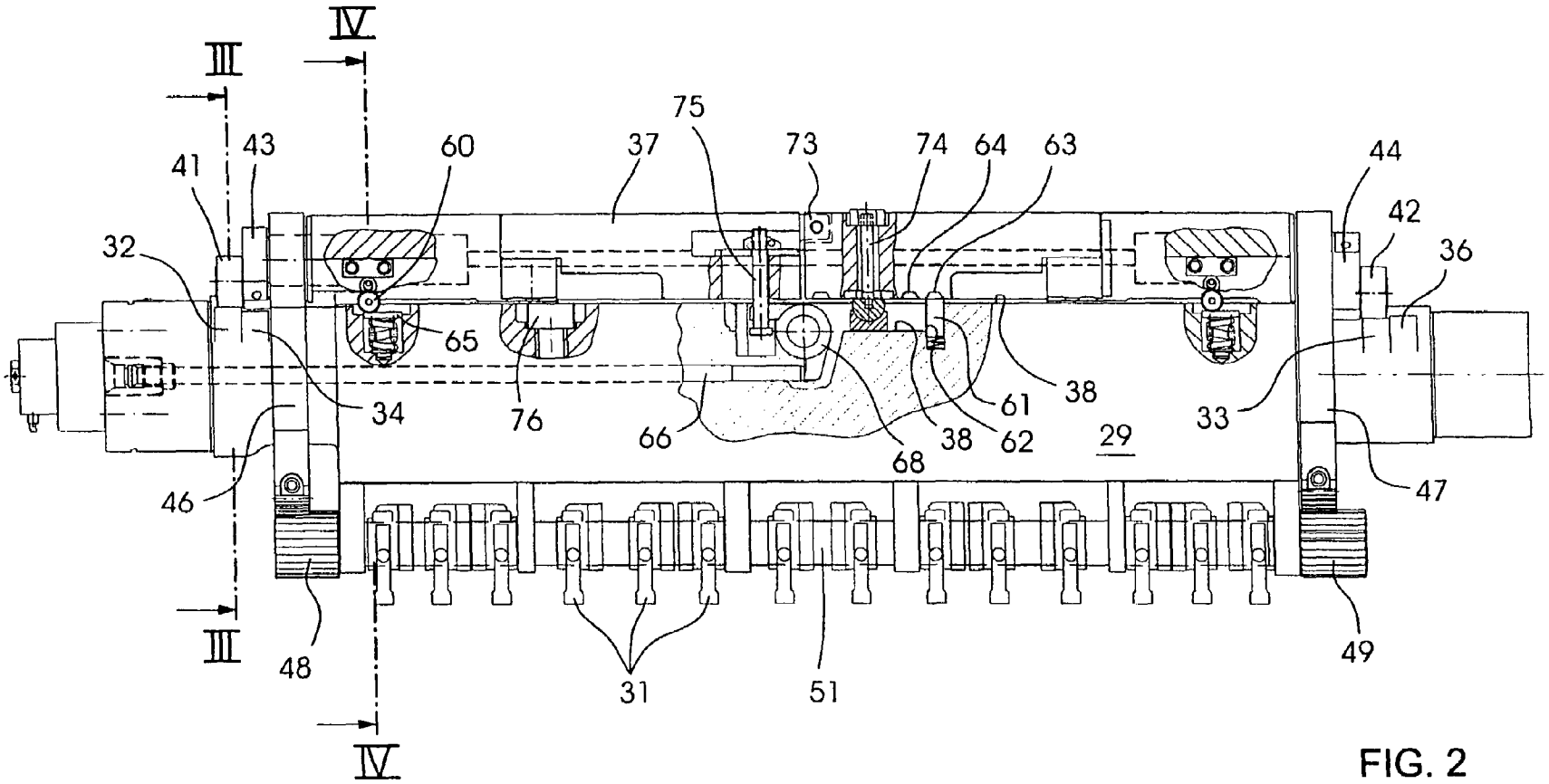
FIG. 2 is a diagrammatic, top plan view of a turning drum.
Figure 3:
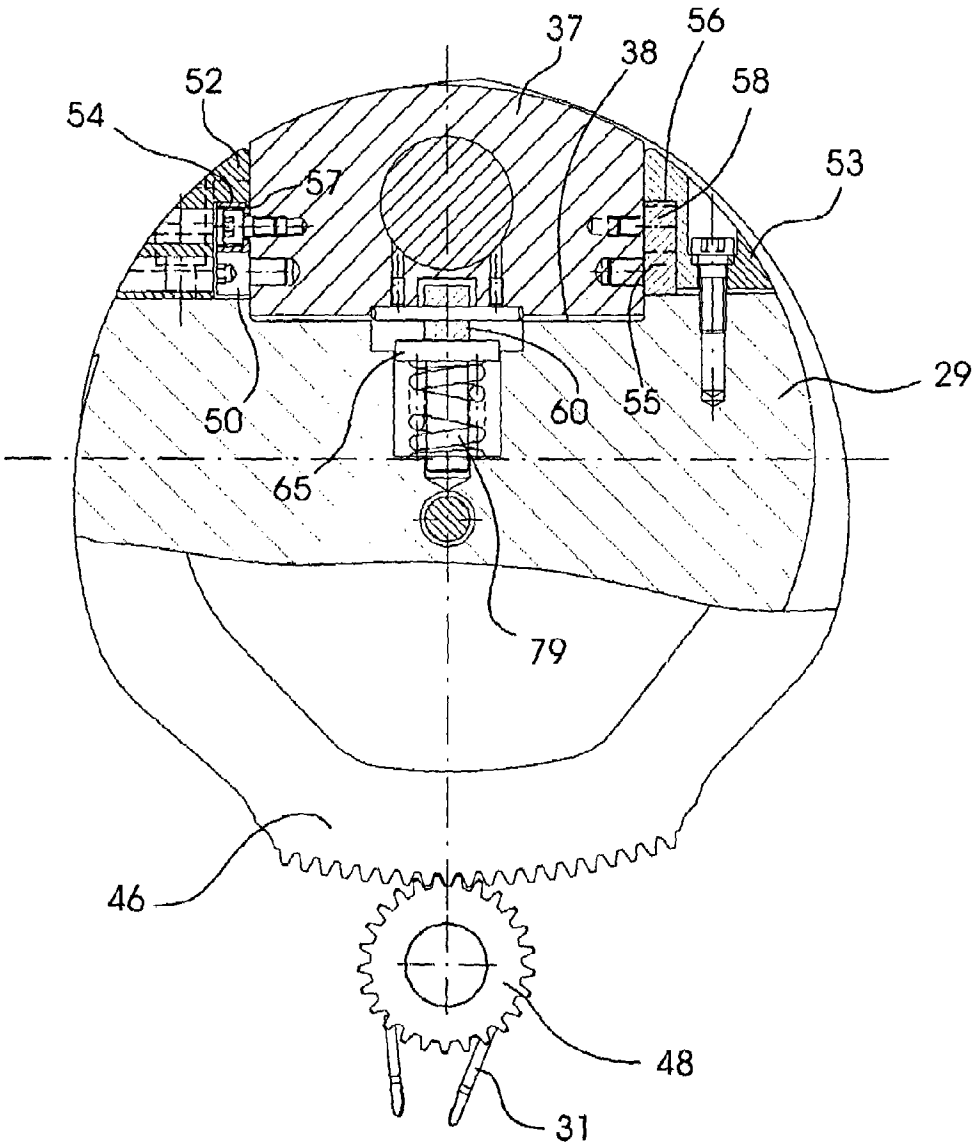
FIG. 3 is a diagrammatic, sectional view taken along the line IV-IV shown in FIG. 2.

Alternatively, a device for detaining the slide 37 in the respective recto or verso printing position according to FIG. 2 may be provided, in order to secure the slide 37 axially against displacement. The detaining device includes essentially of at least one sprung bolt or of a ball 61 which is disposed in a bore 62 on the bottom of the cylinder channel 38 and which can be latched into a first latching recess 63 on the underside of the slide 37 when the latter is displaced into the recto printing position or can be latched into a second latching recess 64 when the slide 37 is displaced into the verso printing position.

If a detaining device 61, 63, 64 is arranged, the frictional coating is dispensed with.

The slide 37 is configured in two parts essentially over its axial length and the two parts are connected to one another only by a joint 73.

The supporting device 74 is screwed approximately centrally to part of the slide 37 in such a way that one end of the supporting device 74 is supported slidably on the channel bottom 38. By virtue of this measure, the slide 37 is supported height-adjustably in the middle and can thus absorb the forces which are applied in each case at the end of the slide 37 by the toothed quadrants 46, 47. By the height being adjusted, angular errors between the pinion 48, 49 and the toothed quadrant 46, 47 can be corrected. The normal force required for detaining the slide axially via the supporting device 74 is applied via the rod 66, the lever 68 and the tie 75.

Figure 5:
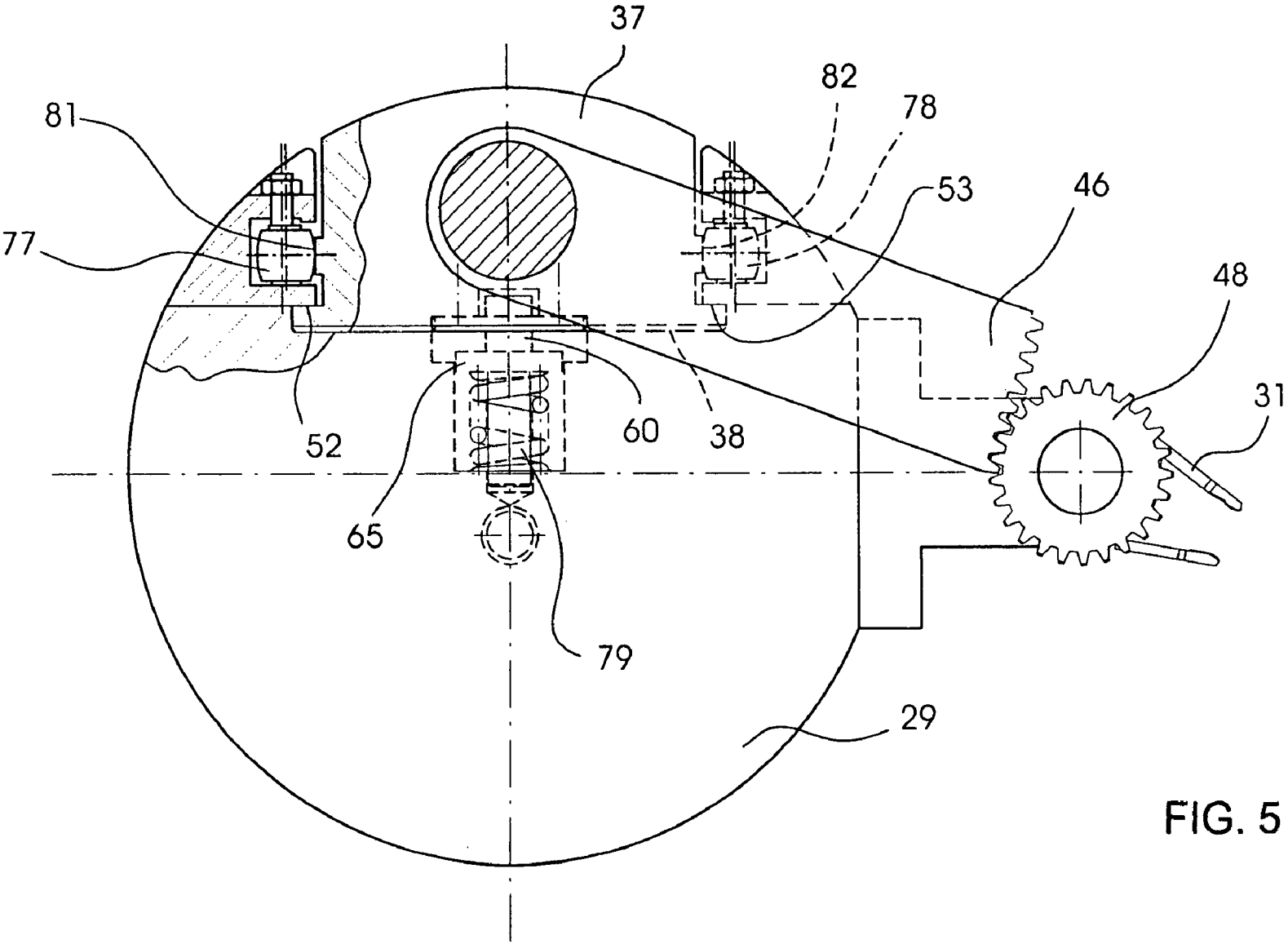
FIG. 5 is a diagrammatic, sectional view of a further exemplary embodiment through the turning drum.

In a preferred embodiment according to FIG. 5, there is provision for arranging the slide 37 in the cylinder channel 38 which is arranged at an angle of approximately 90° to the gripper 31. The radial stops 52, 53 for the slide 37 are arranged fixedly, so that the slide 37 is pressed against the stops 52, 53 by the force of the springs 79. To set the tooth play between the toothed quadrant 46 and pinion 48, the slide 37 is arranged so as to be displaceable laterally in the cylinder channel 38. For this purpose, the slide 37 has laterally stops 81, 82 which are in operative contact with eccentrically adjustable rollers 77, 78.

This application claims the priority, under 35 U.S.C. §119, of German patent application No. 10 2004 048 111.3, filed Oct. 4, 2004; the entire disclosure of the prior application is herewith incorporated by reference.

We claim:

1. A device for changing over a gripper control from recto printing to verso printing on a transfer device selected from the group consisting of a drum and a cylinder of a turning configuration in a sheet-processing machine, the transfer device having a channel formed therein, the device comprising:

a control apparatus for actuating grippers;

radial stops radially disposed in the channel of the transfer device;

spring-loaded force accumulators disposed in the channel; and an axially adjustably disposed slide carrying said control apparatus, said slide being guided axially displaceably in the channel of the transfer device by said radial stops, in each operating state, said slide being pressed, free of play, against said radial stops by said spring-loaded force accumulators.

2. The device according to claim 1, wherein said slide has a radially adjustable guide device co-operating with said radial stops.

3. The device according to claim 1, further comprising actuating elements and said slide co-operates with said actuating elements for lateral guidance.

4. The device according to claim 3, wherein said actuating elements are eccentrically adjustable rollers.

5. The device according to claim 1, wherein said slide is configured in two parts over its axial length, and has a joint connecting said two parts to one another.

6. The device according to claim 1, further comprising an adjustable supporting device disposed between said slide and a bottom of the channel.

7. The device according to claim 6, further comprising:

pinions; and toothed quadrants, an angular position of said pinions and of said toothed quadrants being varied by said adjustable supporting device.

8. The device according to claim 1, wherein said slide has an underside with a latching recess formed therein; and further comprising at least one sprung bolt disposed in a bottom of the channel, said sprung bolt can be latched into said latching recess provided on said underside of said slide.

9. The device according to claim 8, wherein said latching recess includes at least one first latching recess for the recto printing position of said slide and at least one second latching recess for the verso printing position of said slide.

10. The device according to claim 1, further comprising a clamping mechanism for axial fixing of said slide.

11. The device according to claim 1, wherein the sheet-processing machine is a printing machine.

* * * * *